United States Patent [19]

Cracraft

[11] 4,176,870

[45] Dec. 4, 1979

[54] SAFETY DOOR HOLDER

[76] Inventor: Julian L. Cracraft, 255 Lexington Dr., Daytona Beach, Fla. 32014

[21] Appl. No.: 874,910

[22] Filed: Feb. 2, 1978

[51] Int. Cl.[2] ..... E05C 17/30

[52] U.S. Cl. ..... 292/338

[58] Field of Search ..... 292/305, 262, 265, 338, 292/339, 336.3

[56] References Cited

U.S. PATENT DOCUMENTS

| | | | |
|---|---|---|---|
| 598,405 | 2/1898 | Williams | 292/339 |
| 1,479,029 | 1/1924 | Dixon | 292/338 |
| 1,631,980 | 6/1927 | Piccirilli | 292/338 |
| 4,005,889 | 2/1977 | Patrick | 292/305 |

*Primary Examiner*—Richard E. Moore

*Attorney, Agent, or Firm*—Mason, Fenwick & Lawrence

[57] ABSTRACT

A composite rigid rod for holding a door in closed position from inside a room by reaction with the room floor includes first and second telescopically connected metal tubes with the upper end of the uppermost rod being of Y-shape and being connected by a metal band to the door knob shaft which prevents the falling or other removal of the rod from the door knob shaft. Additionally, the metal tubes are adjustably connected to achieve a desired composite rod length and a retainer clamp is mounted on the inner surface of the door so that the rod can be swung about the axis of the knob shaft to position its lower end in the retainer clamp to hold the rod in an inoperative stored position.

9 Claims, 7 Drawing Figures

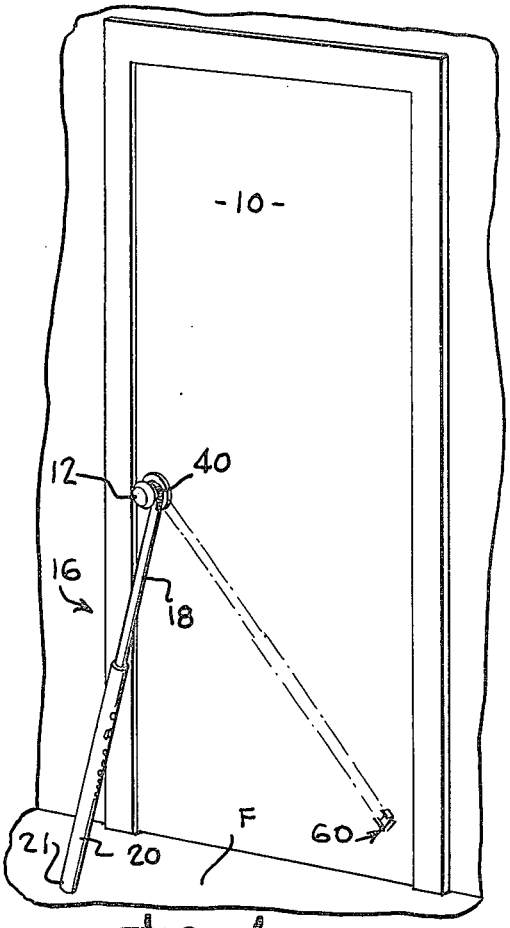
Fig-1
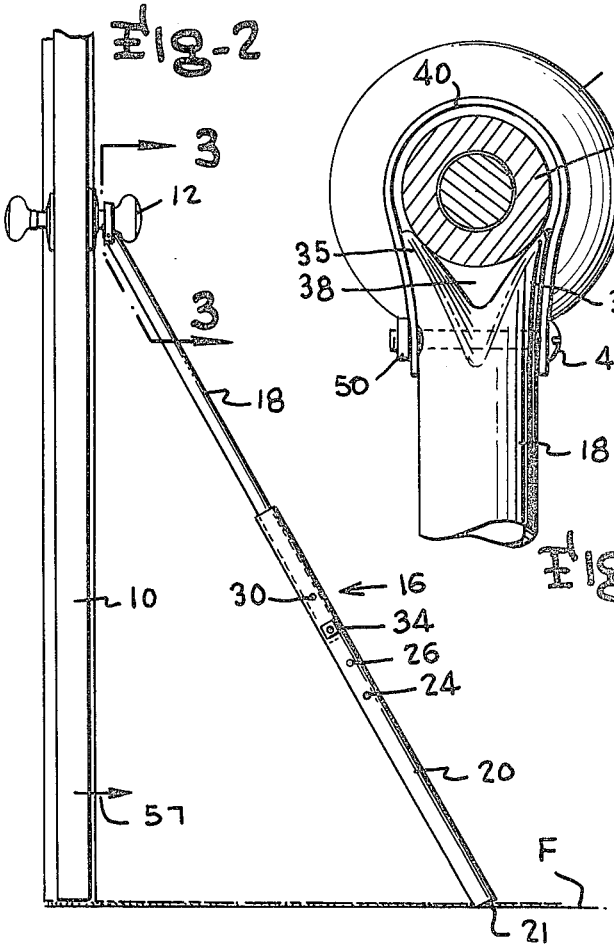
Fig-2
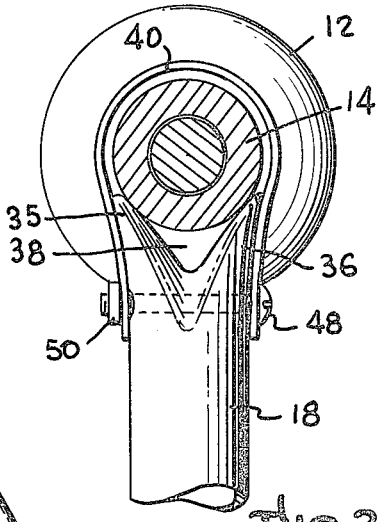
Fig-3
Fig-5
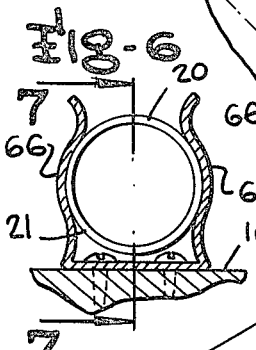
Fig-6
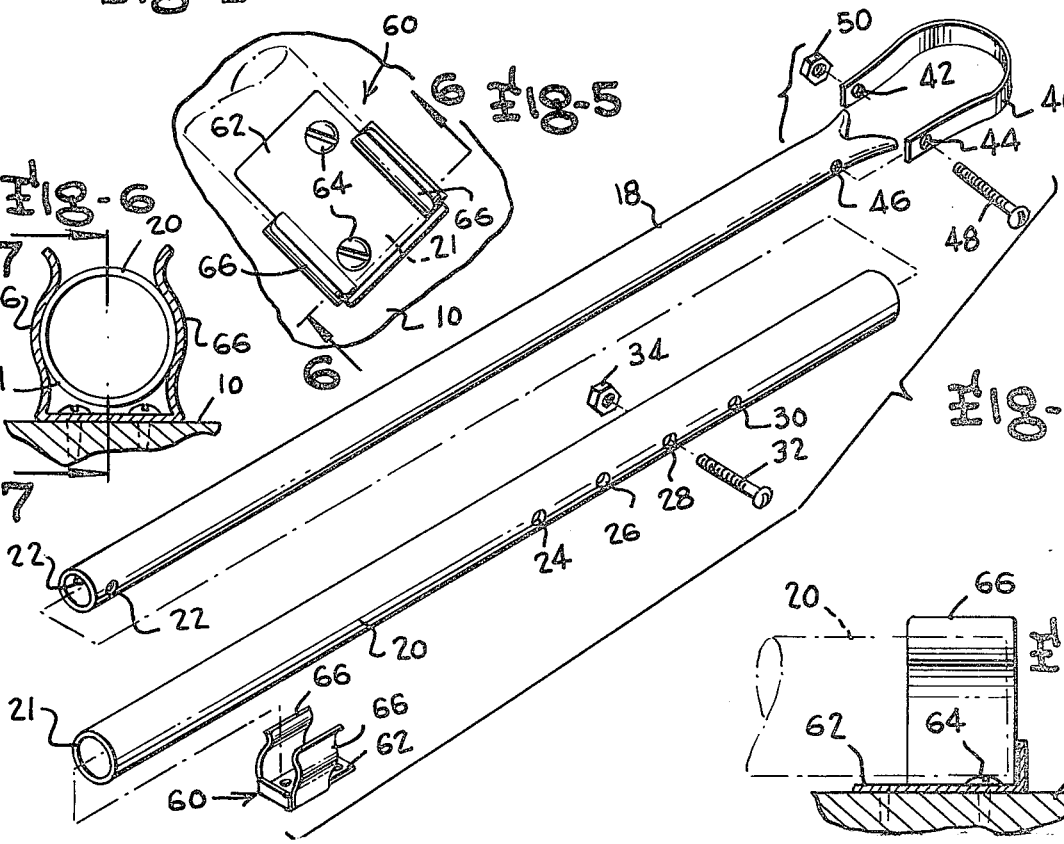
Fig-4
Fig-7

SAFETY DOOR HOLDER

This invention is in the field of security devices for the protection of life and property and is specifically directed to the field of auxiliary door opening preventing devices for securing protection for the occupants and contents of a room. Even more specifically, this invention is directed to a unique reactive door jamming safety door holding device that can be permanently attached to a doorknob but which can be selectively used as required; however, the device can be removed easily as to be usable on other door such as in hotels or the like which require additional security precautions. Moreover, the device can be used with doors of varying sizes due to built-in size adjustment capability of the device which permits usage with a wide variety of door sizes.

It is an unfortunate but true fact that many rooms even in the most expensive and modern buildings such as hotels, motels and apartments do not provide security for the room occupants notwithstanding the fact that such rooms may be provided with expensive locks, bolts or the like. While a good quality lock will provide substantial apparent security, the ease with which keys can be acquired and/or duplicated by criminally inclined persons regretably renders lock security illusory in many instances. As a result of the foregoing unreliability of locking systems, practically all hotel, motel, apartment and similar rooms are provided with manually operable chains, bolts and the like which can be locked or attached on the inside of the room between the door and the door frame. However, such bolts, chains and the like can frequently be forced from either the door or the door frame to which they are attached; moreover, chains can be cut from outside the door by the use of heavy-duty bolt cutters and door locking bolts can frequently be manipulated to an open position. Consequently, bolt and chain door securing means, while providing greater security than locks alone, frequently fail to provide adequate security.

The foregoing inadequacies of door locks, door bolts and security chains has resulted in other proposals for providing reactive brace means jammed between the door knob shaft and the floor of the room for holding the door shut. Devices of the foregoing type are exemplified in U.S. Pat. Nos. 1,304,394; 3,583,743 and 4,019,765. Unfortunately, the devices of the foregoing patents, while providing a substantial additional safety factor over other door lockiing and bolt constructions, can sometimes be manipulated by repeated minute vibratory cyclic movements of the door and the door knob to cause the bracing member to fall away from the door jamming position to permit unauthorized entry into the room. Also, it is also possible under some circumstances for the reactive door jamming member to be removed from its locking position by the passage of a wire or other implement beneath the door to engage the lower end of the door jamming rod member to deflect it outwardly so that the rod member falls from its jamming door restraining position to the floor so that the door can then be easily opened. Such undesirable disengagement of the prior known reactive door jamming devices is permitted by virtue of the fact that such devices are not connected to the door or door knob and can consequently sometimes be caused to fall from their closed door holding and retaining position.

Therefore, it is the primary object of this invention to provide a new and improved safety door holder.

Another object of the invention is the provision of a new and improved reactive force type door jamming member.

Achievement of the foregoing objects is enabled by the preferred embodiment which consists of an elongated composite rigid rod having an upper end connected to the door knob shaft and having a lower end jammingly engaged with the floor of the room at a location outwardly spaced from the inside surface of the door. The reactive door jamming rod comprises an upper tubular end portion and a lower tubular end portion which respectively comprises first and second telescopically connected steel tubes through which a plurality of alignable openings extend. A bolt and nut assembly can be positioned to extend through selected openings in the tubes for effecting a desired adjustable length for the composite rod member formed of the two tubes portions in accordance with the height of the particular door knob to which it is to be connected. Consequently, it is possible to adjust the length of the door jamming rod member in order to obtain optimum locking effectiveness for the particular door with which it is being employed. The invention can be used with either a left hand or right hand door.

Additionally, the upper end of the door jamming composite rod member includes a bifurcated Y-shaped end portion consisting of two outwardly flared arm members between which a V-shaped slot is defined with the slot normally fitting over the door knob shaft to prevent pateral lifting of the upper end of the rod. Moreover, a flexible metal band extends about the door knob shaft and has its opposite end positioned in engagement with the upper end portion of the rod with a bolt and nut locking assembly extending through openings in the flexible band and aligned openings in the upper end of the rod so as to permit the band to be attached or removed from the upper end of the rod. Attachment of the band about the door knob shaft and to the upper end of the rod causes the upper end of the rod to be maintained in the position adjacent the door knob shaft so that it cannot fall to the floor notwithstanding any vibrations or manipulations of the door or the door knob or of the lower end of the rod member.

A better understanding of the manner in which the preferred embodiment of the invention achieves the foregoing objects will be enabled when the following written description is considered in conjunction with the appended drawings in which:

FIG. 1 is a perspective view of the preferred embodiment of the invention as installed in locking position on a door;

FIG. 2 is a side elevation view of the preferred embodiment installed in locking position on a door;

FIG. 3 is a sectional view taken along lines 3—3 of FIG. 2;

FIG. 4 is an exploded perspective view of the components of the preferred embodiment;

FIG. 5 is a front elevation view of rod clamping means attached to the inside surface of the door;

FIG. 6 is a sectional view taken along line 6—6 of FIG. 5; and

FIG. 7 is a sectional view taken along line 7—7 of FIG. 6.

Attention is initially invited to FIGS. 1 and 2 of the drawings which illustrate the preferred embodiment of the invention as viewed from inside a room having a floor F in conjunction with an entrance door 10. It is the purpose of the inventive device to prevent unwarranted entry into the room through door 10. Door 10 includes a door knob 12 of any conventional design and a door knob shaft 14 on which the knob is mounted or which can comprise a unitary rearward extension of the knob. In any event, shaft 14 is engaged with the upper end of the preferred embodiment, generally designated 16, in a manner to be discussed.

The preferred embodiment 16 of the invention comprises an elongated rigid rod which consists of an upper tubular rod portion 18 and a lower tubular rod portion 20. The upper tubular rod portion 18 has its lower end telescopically received within the upper end of the lower rod portion 20 with two diametrically aligned openings 22 in the lower end of the upper tubular rod portion 18 being positioned in alignment with a selected pair of diametrically aligned openings 24, 26, 28 or 30 in the upper end of the lower tubular rod portion.

A connector bolt 32 extends through the openings 22 and the selected pair of openings 24, 26, 28 or 30 to obtain a rigid rod of a desired length in accordance with the most effective length necessary for holding the particular door member 10. Obviously, the most effective length for the composite rod member will depend upon the height of the door knob shaft above the floor F of the room with which the door 10 is associated. It should be noted that a nut 34 is provided on the end of connector bolt 32 for holding the bolt in position in a well-known and obvious manner.

The upper end of the upper tubular rod portion 18 comprises a generally Y-shaped bifurcated end element consisting of first and second outwardly flared arms 35 and 36 between which a slot 38 is defined. Slot 38 engages the lower side of door knob shaft 14 as best shown in FIG. 3.

Attachment means for connecting the upper end of the upper rod portion 18 to the door knob shaft 14 includes a relatively flexible metal band 40 having openings 42 and 44 adjacent its opposite ends positionable in alignment with diametrically aligned openings 46 (FIG. 4) in the upper rod portion 18. An attachment bolt 48 extends through the openings 42, 44 and 46 and is held in position by a nut 50 so as to maintain the flexible metal band 40 connected to the upper end of the rod member; consequently, the upper end of the rod member cannot fall away from the position adjacent the door knob shaft 14. However, if it is desired to remove the assembly from the particular door, such removal can be effected quite simply by removal of nut 50 and the attachment bolt 48 in an obvious manner.

When the elongated rigid rod 16 is positioned as shown in FIGS. 1 and 2, the lower end 21 of lower rod portion 20 engages the floor F so that any attempted opening of the door in the direction of arrow 57 results in a reactive force against the door knob shaft 14 which will clearly prevent opening movement of the door. Moreover, minor juggling movements, pounding or vibratory movement of the door or door handle or deflection of the lower end 21 of the rigid rod will not result in the falling of the rod from its jamming position so that it will be maintained in the door locking position to provide substantially enhanced security for the occupants of the room.

However, the reactive door jamming means can be easily deactivated by the occupant of the room by simply lifting the lower end of the rigid rod from engagement with the floor F and a subsequent swinging positioning of the reactive door jamming member into the dotted line position illustrated in FIG. 10. In this position, the lower end 21 of the lower tubular rod portion 20 is clamped by a retainer clamp 60. Retainer clamp 60 comprises a base plate 62 attached to the inside surface of the door 10 by a pair of screws 64 and a pair of flexible clamp plates 66 dimensioned and spaced so that the lower end 21 of the rod can be positioned therebetween as shown in FIG. 6. The clamp plates 66 retain the lower end of rod portion 20 in an obvious manner so that the entire device is snugly secured in the inoperative dashed line position illustrated in FIG. 1 from which it can be easily returned to the solid line locking position of the same figure.

Consequently, it will be seen that the preferred embodiment provides a reactive force type door jamming rod member which would be very difficult to dislodge from its door locking position and which is capable of usage in a wide variety of locations. Additionally, the device can be removed from the door and stored in a compact manner by telescopically inserting the upper tubular rod portion 18 to its fullest extent in the lower tubular rod portion 20. Additional openings can be provided in the upper and lower rod portions for maintaining the rod portions 18 and 20 in such compact position for storage or transportation. It should be understood that many obvious modifications of the preferred embodiment will undoubtedly occur to those of skill in the art. For example, the materials of which the components are formed are not limited to metal and other materials could be used if desired. Additionally, it would be possible to use a friction increasing rubber cap or the like on the lower end 21 of lower rod portion 20 for avoiding damage to the floor F or for increasing the frictional contact between the rod member and the floor. Therefore, it should be understood that the spirit and scope of the invention is to be limited solely by the appended claims.

I claim:

1. A security device for doors of the type having a doorknob having a shaft portion, said security device comprising an elongated rigid rod having an upper end and a lower end and being of a length greater than the distance from the doorknob to the floor of the room, attachment means including a relatively flexible band member loosely encircling the doorknob shaft portion so as to be easily swingable about the axis of the doorknob shaft and connected on opposite ends to the upper end of the elongated rigid rod for supportingly attaching the upper end of said elongated rigid rod to said doorknob so that the rigid rod is easily swingable about the axis of the doorknob shaft with the lower end of said elongated rigid rod also being positionable to engage the floor in front of the door at a spaced distance from the door to prevent opening movement of the door by applying a jamming reactive force thereagainst in response to any attempted opening movement of the door.

2. The invention of claim 1 wherein said band member loosely encircling the doorknob shaft portion is connected on opposite ends to the upper end of the elongated rod which comprises a bifurcated generally Y-shaped end portion having first and second flared arm portions engageable with opposite sides of the doorknob shaft.

3. The invention of claim 1 further including a rod clamp attached to the door at a location transversely spaced from the vertical plane in which the doorknob shaft is located for permitting the lower end of the elongated rigid rod to be easily positioned in and retained in said clamp out of contact with the floor so as to permit opening of the door.

4. The invention of claim 1 further including a rod clamp attached to the door at a location transversely spaced from the vertical plane in which the doorknob shaft is located for permitting the lower end of the elongated rigid rod to be retained in said clamp out of contact with the floor so as to permit opening of the door wherein said elongated rigid rod is formed of first and second rod portions and further includes connector means permitting the rigid connection of said first and second rod portions for permitting varying of the overall length of said elongated rigid rod member in accordance with the distance between the doorknob shaft and the floor.

5. The invention of claim 1 additionally including bolt means connecting the opposite ends of said band member to the upper end of the elongated rigid rod, said upper end of the elongated rigid rod comprising a generally Y-shaped portion having first and second arm portions between which a slot is defined in which the doorknob shaft is positioned and further including a rod clamp attached to the door at a location transversely spaced from the vertical plane in which the doorknob shaft is located for permitting the lower end of the elongated rigid rod to be retained in the rod clamp out of contact with the floor so as to permit opening of the door wherein said elongated rigid rod is formed of first and second rod portions and further includes connector means permitting the rigid connection of said first and second rod portions to each other for varying the overall length of said elongated rigid rod member in accordance with the distance between the doorknob shaft and the floor.

6. The invention of claim 1 further including a rod clamp attached to the door at a location transversely spaced from the vertical plane in which the doorknob shaft is located for permitting the lower end of the elongated rigid rod to be retained in said clamp out of contact with the floor so as to permit opening of the door wherein said elongated rigid rod is formed of first and second tubular rod portions and removable pin means extending through said alignable openings for maintaining a connection between said tubular rod portions effecting a desired length for said elongated rod member.

7. The invention of claim 1 wherein said attachment means includes removable connector means comprising a bolt extending transversely through the upper end of the rod and through an aperture provided in each end of the relatively flexible band member permitting disconnection of said attachment means from the doorknob shaft.

8. The invention of claim 7 wherein said band member loosely encircling the doorknow shaft portion is connected on opposite ends to the upper end of the elongated rod which comprises a generally Y-shaped end portion including first and second arm portions engageable with opposite sides of the doorknob shaft.

9. The invention of claim 7 wherein said band member loosely encircling the doorknob shaft portion is connected on opposite ends to the upper end of the elongated rod and further including a rod clamp attached to said door at a location transversely spaced from the vertical plane in which the doorknob shaft is located for permitting the lower end of the elongated rigid rod to be retained in said clamp out of contact with the floor so as to permit opening of the door.

* * * * *